United States Patent [19]

Nakagawa

[11] Patent Number: 4,999,492

[45] Date of Patent: Mar. 12, 1991

[54] INDUCTIVELY COUPLED PLASMA MASS SPECTROMETRY APPARATUS

[75] Inventor: Yoshitomo Nakagawa, Tokyo, Japan

[73] Assignee: Seiko Instruments, Inc., Chiba, Japan

[21] Appl. No.: 497,601

[22] Filed: Mar. 22, 1990

[30] Foreign Application Priority Data

Mar. 23, 1989 [JP] Japan ..... 1-71237

[51] Int. Cl.[5] ..... H01J 49/26

[52] U.S. Cl. ..... 250/281; 250/288

[58] Field of Search ..... 250/281, 282, 288; 315/111.81, 111.51

[56] References Cited

U.S. PATENT DOCUMENTS

| | | | |
|---|---|---|---|
| 4,682,026 | 7/1987 | Douglas | 250/288 |
| 4,746,794 | 5/1988 | French et al. | 250/288 |
| 4,760,253 | 7/1988 | Hutton | 250/281 |
| 4,812,040 | 3/1989 | Marcus et al. | 250/288 |

*Primary Examiner*—Bruce C. Anderson

*Attorney, Agent, or Firm*—Spensley Horn Jubas & Lubitz

[57] ABSTRACT

An apparatus for carrying out inductively coupled plasma mass spectrometry to effect identification and quantification of a trace element contained in a sample solution. A plasma torch is provided for converting the sample solution into a plasma. A sampling interface has a sampling orifice and a skimmer orifice for drawing therethrough the plasma to form an ion beam. A mass filter is provided for effecting mass-separation of the ion beam to filter ions. A detector detects ions which pass through the mass filter. An optical system is composed of a lens, a deflector and a junction member for efficiently introducing the ion beam from the sampling interface into the mass filter. An ammeter is connected to the junction member between the optical system and the mass filter. A monitoring device is provided for monitoring the state of the ion beam within the optical system according to the output of the ammeter and an adjusting device is provided for adjusting the optical system while monitoring the output of the ammeter and an output of the detector.

5 Claims, 2 Drawing Sheets

INDUCTIVELY COUPLED PLASMA MASS SPECTROMETRY APPARATUS

BACKGROUND OF THE INVENTION

The present invention relates to a high frequency or radio frequency inductively coupled plasma mass spectrometry apparatus (hereinafter, referred to as "ICP-MS") for carrying out analysis of a trace element contained in a sample solution.

ICP-MS apparatus typical of the prior art, as shown in FIG. 2, is comprised of a plasma torch 1 for producing a plasma 2, a sampling orifice 3 which has a small opening diameter, a skimmer orifice 4 having a small opening diameter for passing an ion beam 5, a lens 6, a deflector 7, a junction member 8c, a mass filter 9, a detector 10, a power supply 11 for powering an optical system, an I/0 interface 12, a computer 13, and a display device 14.

A sample solution (not shown) is fed to the plasma torch 1 together with a carrier gas such as argon to form the plasma 2, which is injected through the sampling orifice 3. A sampling interface is formed by the sampling orifice 3, the skimmer orifice 4 and a vacuum region between orifices 3 and 4. A vacuum is created in the latter region by a suitable vacuum device (not shown).

Plasma torch 1 emits plasma 2 toward sampling orifice 3 and this plasma travels along a path having an introduction axis which extends through, and is centered in, orifices 3 and 4. The plasma 2 passes through the sampling interface to form the ion beam 5.

The optical system is composed of lens 6 having an optical axis aligned with the above-mentioned introduction axis, deflector 7 and junction member 8c and functions to introduce the ion beam 5 efficiently to mass filter 9 while blocking light emitted from plasma 2. Namely, deflector 7 deflects ion beam 5 from the introduction axis of plasma torch 1, the sampling interface and the lens 6 to a laterally offset exit axis defined by a passage in junction 8c and mass filter 9 so as to block light, which travels along linear paths, from reaching mass filter 9. At the same time, lens 6 operates to focus ion beam 5 onto an inlet of mass filter 9, which inlet is defined by the passage in junction member 8c.

The ion beam 5 which enters mass filter 9 contains various ion species and a given ion species having a particular mass specified by computer 13 can reach an outlet of the mass filter, while other ion species will be diverted in mass filter 9. The ion species passing through mass filter 9 is detected by detector 10 and the detected ions are counted. The counting result is fed through I/0 interface 12 to computer 13.

Computer 13 operates to identify a particular trace element within the sample solution and to calculate the concentration thereof according to the counting result from detector 10 and the mass information fed to mass filter 9. The identification and calculation results are indicated in display device 14.

The mass filter is normally composed of a quadrupole mass spectrometer, and the detector is composed of a channeltron. The optical system, mass filter 9 and detector 10 are disposed within a high vacuum space evacuated by a vacuum pump (not shown). Adjustment of the lens 6 and deflector 7 is manually carried out by the operator, together with regulating of power supply 11 for the optical system while monitoring the output level of detector 10.

In the conventional apparatus, as described above, adjustment of the optical system is effected manually based solely on the output signal from detector 10. This has given rise to various problems. For example, adjustment is extremely time-consuming and complicated, especially when the operator is not fully familiar with the structure and features of the optical system. Moreover, the results of the quantity analysis may not be reliable, especially in the lower critical range of the detector, when the solution analysis is undertaken with incomplete adjustments.

SUMMARY OF THE INVENTION

It is an object of the present invention to resolve the above-noted problems, improve the reliability of the analysis results of an ICP-MS and achieve efficient adjustment of an ICP-MS.

Another object of the present invention is to provide an ICP-MS apparatus which is adjustable such that the intensity of the ion beam arriving at the junction between the optical system and the mass filter is measured by an ammeter to monitor the position and focusing state of the ion beam spot within the optical system, and the output level of the detector is also concurrently monitored so as to adjust the optical system based on these related monitoring operations.

In order to realize the above objects, the present invention is applied to ICP-MS apparatus of the type having a plasma torch for converting a sample solution into plasma, a sampling interface composed of a sampling orifice and a skimmer orifice for introducing the plasma into a vacuum space provided in the sampling interface to thereby inject an ion beam of the plasma, a mass filter for carrying out mass-separation of the ion beam to selectively pass a particular ion species, an optical system composed of a lens, a deflector and a junction portion for efficiently directing the ion beam injected from the sampling interface to the mass filter, and a detector for detecting the particular ion species which passes through the mass filter. The inventive ICP-MS apparatus is characterized in that a current measuring device is connected to the junction portion of the optical system for monitoring the location and focusing state of the ion beam spot so as to compare the outputs of the current measuring device and the detector with each other as a guide to the adjustment of the optical system.

In operation of the inventive ICP-MS apparatus, a current intensity is measured by the current measuring device for the ion beam which reaches the junction portion between the optical system and the mass filter to monitor the position and focusing state of the ion beam spot. Then, the current device output and the detector output are processed relative to each other to indicate the proper adjustment of the optical system.

DESCRIPTION OF THE PREFERRED EMBODIMENTS

Figure 1:
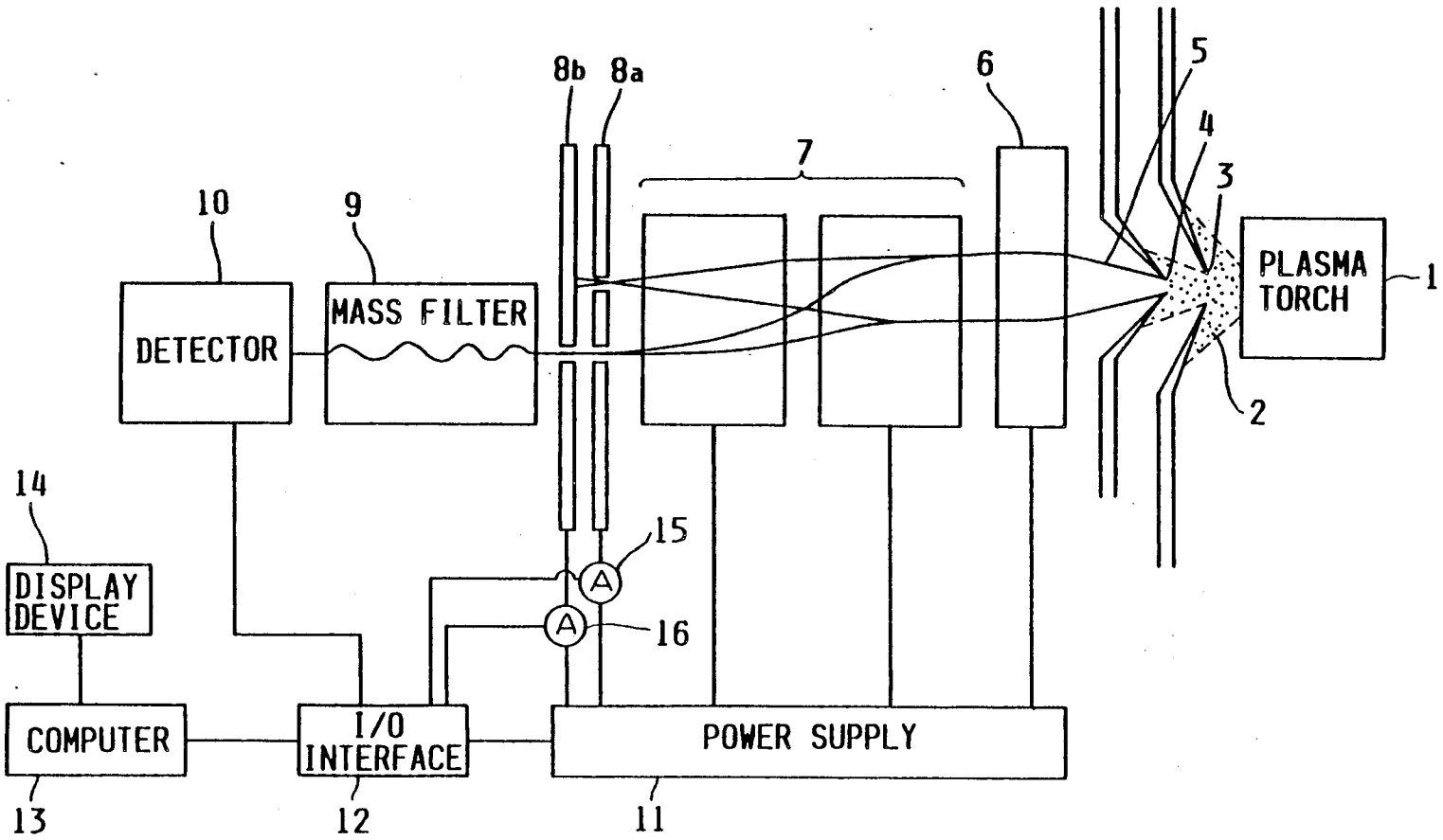
FIG. 1 is a schematic block diagram showing an embodiment of the present invention.
Figure 2:
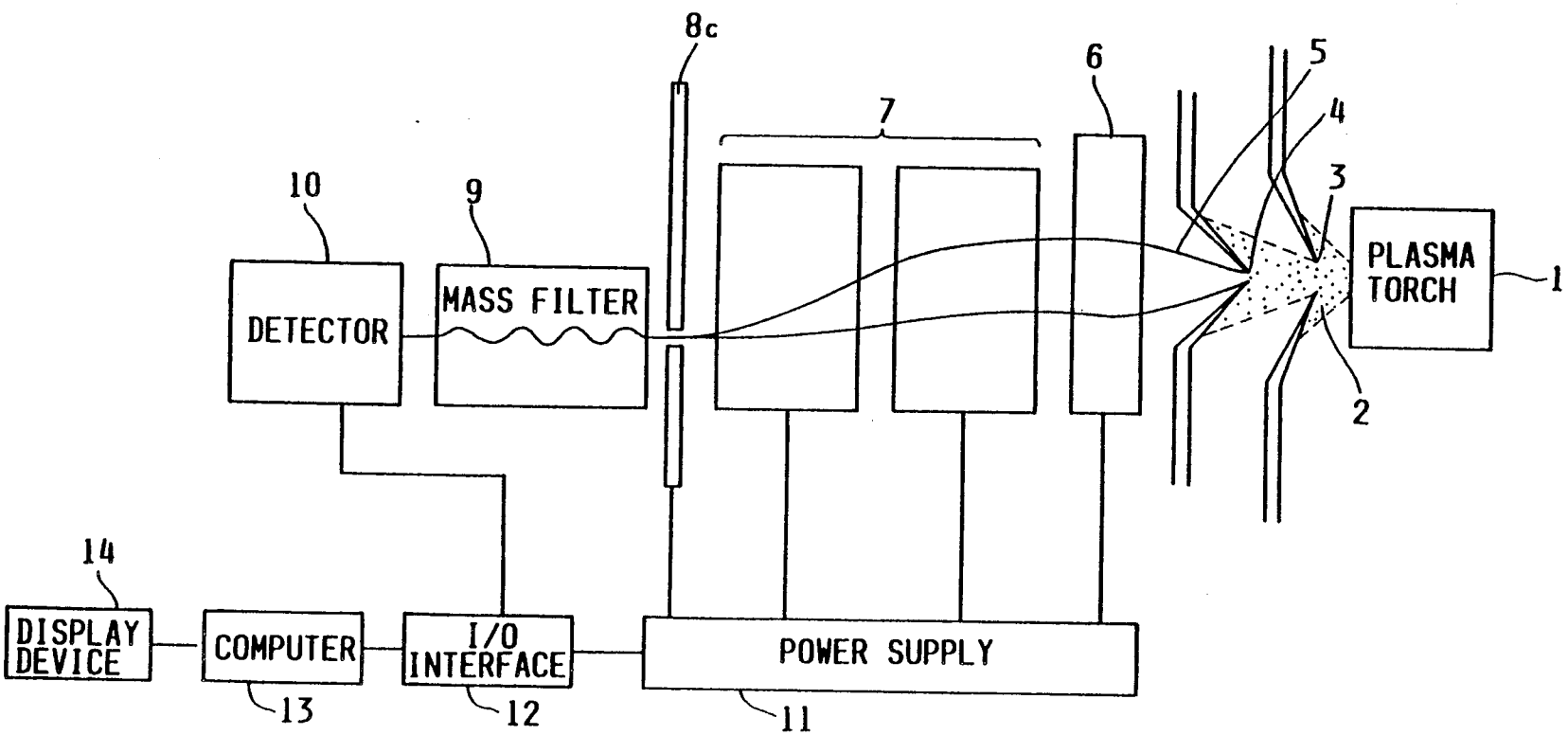
FIG. 2 PRIOR ART
FIG. 2 is a block diagram showing a conventional ICP-MS apparatus.

A preferred embodiment of an ICP-MS according to the invention is shown in FIG. 1 and has in common with the prior art apparatus of FIG. 2 a plasma torch 1 for producing plasma 2 from a sample solution (not shown), plasma 2 being drawn or introduced into a sampling interface between sampling orifice 3 for entrance of the plasma 2 and succeeding skimmer orifice 4 for skimming the plasma 2 to form ion beam 5 of the plasma. The optical system is connected to the sampling interface to deflect and focus the ion beam 5. The optical system is composed of lens 6 for focusing ion beam 5, deflector 7 having a pair of electrodes for deflecting the ion beam 5 in parallel manner from the introduction axis along which the plasma torch 1, sampling orifice 3, skimmer orifice 4 and lens 6 are aligned with each other, and a junction portion composed of a pair of the first and second junction plates 8*a* and 8*b* positioned perpendicular to the above-mentioned axis and parallel to each other, while being spaced apart in the direction of that axis. Mass filter 9 is connected to the optical system through the junction portion to receive therethrough the ion beam so as to mass-filter the received ion beam to selectively pass a particular species of ion originating from a trace element contained in the sample solution. Detector 10 is connected to the mass filter 9 to detect the intensity of the ion beam filtered by the mass filter. As described thus far, this apparatus corresponds to that of FIG. 2, except for plates 8*a* and 8*b*.

The first junction plate 8*a* is formed with a first passage aligned with the axis of components 1–4 and 6 and a second passage laterally offset from the first passage and aligned with the inlet of mass filter 9. A first current measuring device, such as an ammeter, 15 is connected to the first junction plate 8*a* such that the first junction plate 8*a* is supplied with a negative potential through the ammeter 15 from power supply 11. The power supply 11 is also connected to the optical system to regulate the power supplied thereto. The first ammeter 15 operates to measure electric current flow induced in the first junction plate 8*a* due to ions striking the plate and to feed a corresponding first monitoring signal to computer 13 through I/0 interface 12. The monitored electric current ranges from several tens of nano A to several micro A.

The second junction plate 8*b* is formed with a passage aligned with the second passage in plate 8*a* and with the inlet port of mass filter 9. This passage in plate 8*b* has a diameter in the order of several millimeters. The second junction plate 8*b* is supplied with a potential from the power supply 11 through a second current measuring device, such as an ammeter, 16. The second ammeter 16 operates to measure or monitor electric current flowing along the second junction plate 8*b* due to ions striking plate 8*b* and to feed a corresponding monitoring signal to computer 13 through I/0 interface 12.

The computer 13 is provided with a display device 14. The lens 6 may be composed of, for example, Eintzel lens, and the deflector 7 may be composed of a parallel-plate type deflector or a quadrupole deflector.

Next, a description is given for the operation of the ICP-MS apparatus to adjust the optical system to efficiently introduce the ion beam 5 into the mass filter 9. Firstly, the same potential is applied to the pair of electrodes of the deflector 7 by power supply 11 to linearly direct the ion beam 5 along the introduction axis of components 1–4 and 6 toward the first page in first junction plate 8*a* and toward the surface of second junction plate 8*b* behind first junction plate 8*a*. Consequently, ions striking plates 8*a* and 8*b* cause electric currents to flow through first and second ammeters 15 and 16. The magnitudes of the electric currents are monitored and indicated on the display device 14. While monitoring the electric currents, the power supply is controlled to regulate the focusing voltage applied to lens 6. When the electric current monitored by ammeter 15 reaches a minimum value and the electric current monitored by ammeter 16 reaches a maximum value, the voltage to the lens 6 will have been set or fixed such that lens 6 is focusing ion beam 5 onto the plane of the first junction plate 8*a* to thereby effect a coarse focusing adjustment of the optical system.

Next, the power supply 11 is controlled to regulate the voltage applied to the deflector 7 to deflect ion beam 5 such that the point of convergence of ion beam 5 is shifted along the first junction plate 8*a* from the first passage to the second passage. Consequently, when the deflected ion beam 5 passes along the exit axis through the second passage of the first junction plate 8*a* and the subsequent aligned passage of second junction plate 8*b*, the voltage to deflector 7 will have been set or fixed to thereby effect the adjustment of the position of the ion beam convergence point. Namely, ion beam 5 can enter into the mass filter 9 along the exit axis. Correct deflection of beam 5 will be signaled by a drop in the current being monitored by ammeter 15.

Lastly, while monitoring the electric currents flowing through ammeters 15 and 16 and monitoring the output level of the detector 10, the power supply 11 is controlled to finely regulate the focusing voltage applied to lens 6. When both electric currents, as measured by ammeters 15 an 16, attain minimum values, respectively, and the output level of detector 10 becomes a maximum, the driving voltage to the lens 6 will have been set or fixed to thereby effect fine adjustment of the focusing state of ion beam 5 relative to mass filter 9. By such operation, the optical system can be optimally tuned to effect the most efficient mass spectrometry of the ion beam.

According to the present invention, the point of convergence, or spot, position and focusing state of the ion beam in the optical system can be monitored so as to facilitate optimum tuning of the optical system by controlling the power supply to regulate the driving voltages applied to focusing lens 6 and deflector 7. By such construction, misadjustments can be avoided to ensure the reliability of the ICP-MS analysis. The control of the power supply may be carried out manually while monitoring the display device, or the control can be carried out automatically by computer 13 through I/0 interface 12 based on the measured and detected data from ammeters 15 and 16 and detector 10 according to the above-described steps or procedure of the adjustment.

This application relates to subject matter disclosed in Japanese Pat. application No. 1-71237, filed on Mar. 23, 1989, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An apparatus for carrying out inductively coupled plasma mass spectrometry to effect identification and quantification of a trace element contained in a sample solution, the apparatus comprising: a plasma torch for converting the sample solution into a plasma; means defining a sampling interface having a sampling orifice and a skimmer orifice disposed for drawing plasma from said torch to form an ion beam; a mass filter for effecting mass-separation of the ion beam to filter selected ions said mass filter having an ion beam inlet; a detector connected for detecting ions which pass through said mass filter; an optical system comprised of a lens, a deflector and a junction member disposed for efficiently directing the ion beam formed by said sampling interface into said mass filter, said junction member being electrically conductive and having a first passage aligned with said mass filter inlet; current measuring means connected to said junction member for measuring current induced in said junction member when the ion beam strikes said junction member; monitoring means connected for monitoring the state of the ion beam within said optical system on the basis of the current measured by said measuring means; and adjusting means connected for adjusting control of the ion beam by said optical system in response to the monitoring result produced by said monitoring means and the detection result produced by said detector.

2. An apparatus according to claim 1 wherein said junction member comprises first and second conductive junction plates disposed in parallel to each other and normal to the path of the ion beam through said optical system, said first junction plate having a first passage aligned with the path followed by the ion beam from said sampling interface when the ion beam is not deflected by said optical system and a second passage offset from said first passage, aligned with said ion beam inlet of said mass filter, and aligned with a path followed by the ion beam when the ion beam is deflected by a selected amount by said deflector, and said second junction plate being interposed between said first junction plate and said mass filter and having a passage aligned with said passage in said first junction plate.

3. An apparatus according to claim 2 wherein said current measuring means comprise a first current measuring device connected to said first junction plate, and a second current measuring device connected to said second junction plate.

4. An apparatus according to claim 3 wherein each said current measuring device is an ammeter.

5. An apparatus according to claim 3 wherein said lens acts to focus the ion beam in accordance with a control voltage and said adjusting means are operative to adjust the control voltage in a direction to minimize the current measured by at least said first current measuring device.

* * * * *